US008701934B2

(12) United States Patent
Alluigi

(10) Patent No.: US 8,701,934 B2
(45) Date of Patent: Apr. 22, 2014

(54) LIQUID DISPENSER DEVICE HEAD FITTED WITH A NOZZLE FUNCTIONING INDICATOR

(75) Inventor: Riccardo Alluigi, Alessandria (IT)

(73) Assignee: Guala Dispensing S.p.A., Alessandria (IT)

( * ) Notice: Subject to any disclaimer, the term of this patent is extended or adjusted under 35 U.S.C. 154(b) by 0 days.

(21) Appl. No.: 13/498,410

(22) PCT Filed: Aug. 31, 2010

(86) PCT No.: PCT/IB2010/053899

§ 371 (c)(1),
(2), (4) Date: Mar. 27, 2012

(87) PCT Pub. No.: WO2011/051825

PCT Pub. Date: May 5, 2011

(65) Prior Publication Data

US 2012/0199605 A1 Aug. 9, 2012

(30) Foreign Application Priority Data

Oct. 29, 2009 (IT) ..... BS2009A0195

(51) Int. Cl.
*B67D 7/06* (2010.01)

(52) U.S. Cl.
USPC ..... 222/23; 222/153.14; 222/321.8; 222/383.1

(58) Field of Classification Search
USPC ..... 222/1, 23, 136, 153.13, 153.09, 153.14, 222/182, 380, 207, 321.7, 154, 340, 548, 222/384, 341, 321.8, 383.1; 239/333, 394, 239/428.5, 477, 288.5, 71–74, 329–332, 239/334, 537–538, 540, 526
See application file for complete search history.

(56) References Cited

U.S. PATENT DOCUMENTS

| | | | | | |
|---|---|---|---|---|---|
| 1,785,866 | A | * | 12/1930 | Huene | 40/491 |
| 3,402,494 | A | * | 9/1968 | Gray | 40/570 |
| 4,161,288 | A | * | 7/1979 | McKinney | 239/333 |
| D256,271 | S | * | 8/1980 | Tada | D23/226 |
| 4,257,539 | A | * | 3/1981 | Cary et al. | 222/182 |
| 4,634,385 | A | * | 1/1987 | Stemper | 434/198 |
| 4,779,803 | A | * | 10/1988 | Corsette | 239/428.5 |
| 5,169,032 | A | * | 12/1992 | Steijns et al. | 222/153.07 |
| 5,207,359 | A | * | 5/1993 | Steijns | 222/383.1 |

(Continued)

FOREIGN PATENT DOCUMENTS

| | | | |
|---|---|---|---|
| JP | 8252508 | A | 10/1996 |
| WO | WO-2006/073307 | A1 | 7/2006 |
| WO | WO-2007/103922 | A2 | 9/2007 |

OTHER PUBLICATIONS

International Search Report and Written Opinion of the ISA for PCT/IB2010/053899, mailed Dec. 23, 2010; International Preliminary Report on Patentability of the IPEA, completed Feb. 28, 2012.

*Primary Examiner* — Paul R Durand
*Assistant Examiner* — Randall Gruby
(74) *Attorney, Agent, or Firm* — Harness, Dickey & Pierce, PLC

(57) ABSTRACT

A dispenser device head (1) of a liquid is provided with a nozzle (20) comprising a lateral wall (30) having through signalling apertures (40) defining a caption or symbol to highlight a functioning configuration.

20 Claims, 6 Drawing Sheets

(56) References Cited

U.S. PATENT DOCUMENTS

| | | | | | |
|---|---|---|---|---|---|
| 5,228,600 | A | * | 7/1993 | Steijns et al. | 222/153.14 |
| 5,341,965 | A | * | 8/1994 | Maas et al. | 222/340 |
| 5,476,195 | A | * | 12/1995 | Oder et al. | 222/207 |
| 5,687,880 | A | * | 11/1997 | Maas et al. | 222/153.14 |
| 5,704,550 | A | * | 1/1998 | Foster et al. | 239/333 |
| 5,706,984 | A | * | 1/1998 | Tada et al. | 222/182 |
| 5,749,501 | A | * | 5/1998 | Maas et al. | 222/384 |
| 5,769,275 | A | * | 6/1998 | Boehmer et al. | 222/136 |
| 5,829,648 | A | * | 11/1998 | Goeren et al. | 222/321.7 |
| 5,848,733 | A | * | 12/1998 | Foster et al. | 222/153.13 |
| 5,938,082 | A | * | 8/1999 | Foster et al. | 222/153.09 |
| 5,975,376 | A | * | 11/1999 | Chelupsky et al. | 222/383.1 |
| 5,984,149 | A | * | 11/1999 | Thanisch et al. | 222/340 |
| 6,286,728 | B1 | * | 9/2001 | Driskell et al. | 222/383.1 |
| 6,446,882 | B1 | * | 9/2002 | Dukes et al. | 239/333 |
| 6,715,698 | B2 | * | 4/2004 | Foster et al. | 239/343 |
| 6,752,296 | B1 | * | 6/2004 | Sweeton et al. | 222/383.1 |
| 7,017,833 | B2 | * | 3/2006 | Foster | 239/333 |
| 7,497,358 | B2 | * | 3/2009 | Clynes et al. | 222/340 |
| D596,938 | S | * | 7/2009 | Broadbent | D9/448 |
| 2002/0066802 | A1 | * | 6/2002 | Tada | 239/333 |
| 2004/0251316 | A1 | * | 12/2004 | Stark | 239/333 |
| 2005/0082311 | A1 | * | 4/2005 | Good et al. | 222/1 |
| 2007/0119982 | A1 | * | 5/2007 | Hildebrand | 239/333 |
| 2007/0181606 | A1 | * | 8/2007 | Foster | 222/383.1 |
| 2007/0210106 | A1 | * | 9/2007 | Foster | 222/153.06 |
| 2007/0295758 | A1 | * | 12/2007 | Foster et al. | 222/383.1 |
| 2009/0050653 | A1 | * | 2/2009 | Maas et al. | 222/383.1 |
| 2009/0152304 | A1 | * | 6/2009 | Foster | 222/340 |

* cited by examiner

LIQUID DISPENSER DEVICE HEAD FITTED WITH A NOZZLE FUNCTIONING INDICATOR

CROSS-REFERENCE TO RELATED APPLICATIONS

This application is a 371 U.S. National Stage of International Application No. PCT/IB2010/053899, filed Aug. 31, 2010, and claims priority to Italian patent application No. BS2009A000195, filed Oct. 29, 2009, the disclosures of which are herein incorporated by reference in their entirety.

FIELD

The present invention relates to a liquid dispenser device head, for example of the trigger type.

BACKGROUND

Such heads usually have a duct which the liquid sent by the piston flows in, before being dispensed to the outside. At the end of the duct there is usually a nozzle, having many functions. For example, often, the nozzle is made so as to rotate on the duct so that in an open position the liquid may be dispensed outwards and in a closed position, rotated compared to the previous, dispensing is prevented in that the duct is closed.

For greater ease of use, the lateral wall of the nozzle is usually provided with raised captions or symbols defining a functioning configuration.

For example, the document U.S. Pat. No. 6,752,296, illustrates a nozzle in which the captions are raised and are made by overmoulding.

The prior solutions present a number of drawbacks however in that the symbols or captions are not clear or the production costs of the nozzle are high.

SUMMARY

The purpose of the present invention is to make a dispenser device head fitted with a nozzle in which the captions or symbols on the lateral wall are clearly visible.

Such purpose is achieved by a dispenser device head according to the described embodiment variations.

DRAWINGS

The characteristics and advantages of the dispenser device head according to the present invention will be evident from the following description made by way of a non-limiting example, with reference to the attached drawings, wherein:

FIG. 1 shows a cross-section view of a dispenser device head according to the present invention, according to one embodiment variation;

FIGS. 2*a* and 2*b* show details of the head in FIG. 1, in two respective functioning configurations;

DETAILED DESCRIPTION

Figure 1:
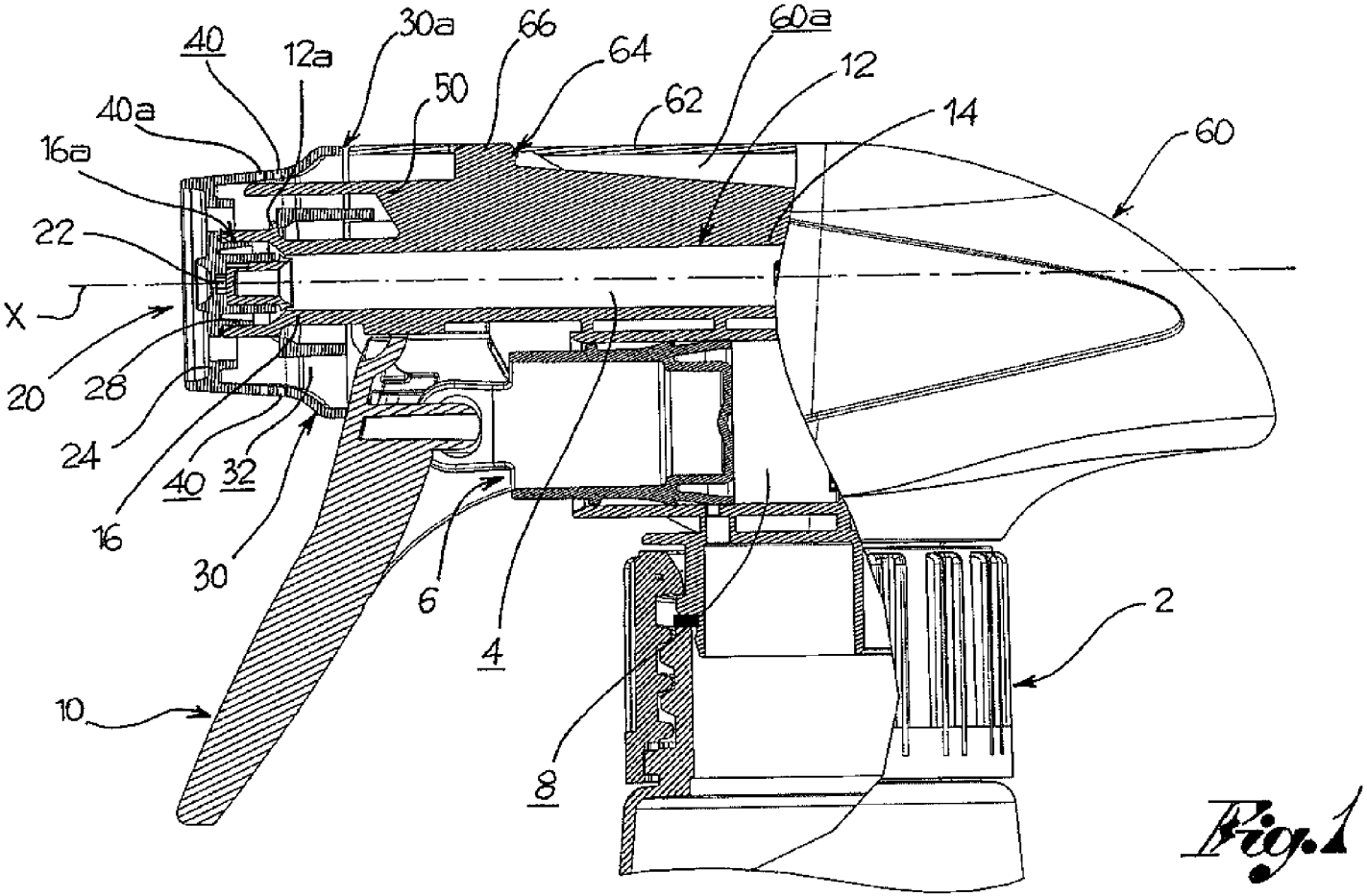

A dispenser device head according to the present invention comprises a container containing a liquid to be dispensed and a dispenser device head 1, which can be joined to the container in a removable manner.

The head 1 preferably comprises means of connecting the head to the container, for example by screwing or with a bayonet connection. For example, the head comprises a bush 2 which can be screwed onto the neck of the container.

Furthermore, the head 1 comprises pumping devices able to aspirate the liquid from the container towards a dispenser duct 4, suitable for being placed in fluidic communication with the outside environment.

For example, the pumping devices comprise a piston 6 sliding in a chamber 8 to aspirate the liquid from the container and send to the duct 4.

Preferably, the head 1 comprises valve devices:

- to regulate the aspiration of the liquid from the container and/or to prevent aspiration from the dispenser duct; and/or
- to regulate the flow of liquid towards the dispenser duct and/or to prevent the flow of liquid towards the container; and/or
- to enable the aspiration of air inside the container and/or prevent the output of liquid from the container.

Furthermore, the head 1 comprises actuation devices suitable for being operated manually to activate the pump devices. For example, the actuation devices comprise a trigger 10 which can rotate or translate to activate the pump devices. The actuation devices preferably are elastic return mechanism.

The dispenser duct 4 is delimited by a tubular wall 12 extending along a dispensing axis X between an input extremity 14, which the liquid sent by the pump devices reaches, and an opposite outlet extremity 16, provided with an outlet aperture 16*a*.

The head 1 is provided with a nozzle 20 coupled to the duct 4 at the outlet extremity 16 of the same; the nozzle 20 has at least one orifice 22, in fluidic communication with the duct 4 for the output of the liquid outwards.

For example, the nozzle 20 comprises a front wall 24, situated opposite the outlet aperture 16*a*, substantially perpendicular to the dispensing axis X, which the orifice 22 is made through in the axial thickness.

Preferably, the nozzle 20 is coupled to the duct 4 in such a way that it can rotate around the dispensing axis (X).

To such purpose, the nozzle comprises coupling devices comprising an annular flange 26, having an axial extension, engaged with the tubular wall 12 so as to turn, for example fitted onto it or fitted onto a crown 12*a* projecting radially from the tubular wall 12.

For example, the coupling devices further comprise a skirt 28 positioned radially inside the flange 26, having an axial extension, engaged with the tubular wall 26 so as to turn, for example fitted inside the portion of tubular wall which defines the outlet aperture 16*a*.

Preferably, moreover, the nozzle 20 comprises closure devices able to interrupt fluidic communication between the duct 4 and the orifice 22.

For example, the closure devices are able to interrupt fluidic communication between the duct 4 and the orifice 22 by rotating said nozzle. This way, in a first angular position of the nozzle, which defines an open configuration, the duct 4 is in fluidic communication with the orifice 22 and the liquid is dispensed to the outside, in a further angular position, which defines a closed configuration, the duct 4 is separated fluidically from the orifice 22 and the liquid is not dispensed outwards.

The nozzle 20 further comprises an outer lateral wall suitable for being gripped by a user, having an axial extension such as to cover the dispensing duct 4 along a section of the same, and having a predefined thickness of wall in a radial direction to said dispensing axis X.

The wall 30 is radially distanced from the tubular wall 12 of the duct 4, so that a nozzle compartment 32 is formed inside the nozzle between said lateral wall 30 and said tubular wall 12.

The nozzle 20 comprises at least one signalling aperture 40, passing through the thickness of the lateral wall 20.

Preferably, the lateral wall 30 is delimited axially by a peripheral wall rim 30*a* and the signalling aperture 40 is delimited by aperture edges 40*a* axially distanced from the wall rim 30*a*. In other words, preferably, the signalling aperture 40 is recessed in relation to the periphery of the lateral wall 30.

According to one embodiment, the signalling aperture 40 is shaped so as to define a caption, such as "ON" or "OFF". In a further embodiment, the signalling aperture 40 is shaped to define a graphic symbol, such as a circle or triangle or a row of holes.

Advantageously, the aperture or apertures on the lateral wall 30 of the nozzle make such captions or symbols particularly evident.

According to a preferred embodiment the dispenser device head 1 further comprises a signalling element 50, positioned in the nozzle compartment 32, visible from the outside through the signalling aperture 40, so that the caption or symbols defined by said signalling aperture are even more evident.

Preferably, the signalling element 50 is made in a contrasting colour to the outer surface of the lateral wall 30, so that the caption or symbols defined by the signalling aperture 40 give the impression of being coloured and stand out particularly from the colour of the outer surface of the lateral wall 30.

Preferably, moreover, the signalling element 50 is positioned and extends so as to cover up the components present in the nozzle compartment, so that these are not visible from the outside through the signalling aperture 40.

Preferably, moreover, the signalling element 50 is supported by the tubular wall 12 of the dispensing duct 4 or by a frame of the head which the tubular wall 12 is part of.

In addition, the head 1 comprises a cover 60 able to cover up the pumping devices, which the nozzle 20, trigger 10 and bush 2 project from.

Preferably, the cover 60 comprises an upper wall 62, distanced from the dispensing axis X and substantially parallel to it, on the side opposite the bush 2 to which the container is connected. A cover compartment 60*a* is formed between the upper wall 62 and the tubular wall 12 of the duct 4. The upper wall 62 is clearly visible to the user of the dispenser device.

Moreover, preferably, the upper wall 62 has at least one indicator aperture 64, passing through its thickness. For example, the indicator aperture 64 is made near the nozzle 20, for example in the shape of a triangle with the vertex pointing towards the nozzle 20.

The indicator aperture 64, which remains fixed while the nozzle is rotated in the different functioning configurations, highlights to the user that the nozzle wall is provided with a symbol or caption and highlights which functioning configuration has been selected.

Preferably, in addition, the head 1 comprises a further signalling element 66, positioned in the cover compartment 60*a* so as to be visible from the outside through the indicator aperture 64.

Preferably, the further signalling element 66 is inserted in the indicator aperture 64, so as for example to come out on the outer surface of the upper wall 62.

Preferably, the further signalling element 66 is made in a contrasting colour to the outer surface of the upper wall 62, so that the caption or symbols defined by the indicator aperture 64 give the impression of being coloured and stand out particularly from the colour of the outer surface of the upper 62.

Preferably, moreover, the further signalling element 66 is positioned and extends so as to cover up the other components present in the cover compartment 60*a*, so that these are not visible from the outside through the signalling aperture 64.

Preferably, moreover, the signalling element 50 and the further signalling element 66 is supported by the tubular wall 12 of the dispensing duct 4 or by a frame of the head which the tubular wall 12 is part of.

According to a preferred embodiment, the indicator element 50 and the further signalling element 66 are made in one piece.

In a first embodiment, the nozzle is attached to the dispenser duct, in other words cannot rotate. The opening and the closing of the duct to dispense liquid occurs, for example, through a hatch hinged to the nozzle, for example by means of a perforated edge.

In such embodiment, the nozzle is provided with the signalling, generally only one, for example to indicate the type of jet coming out of the orifice or the type of liquid in the container.

Figure 2A:
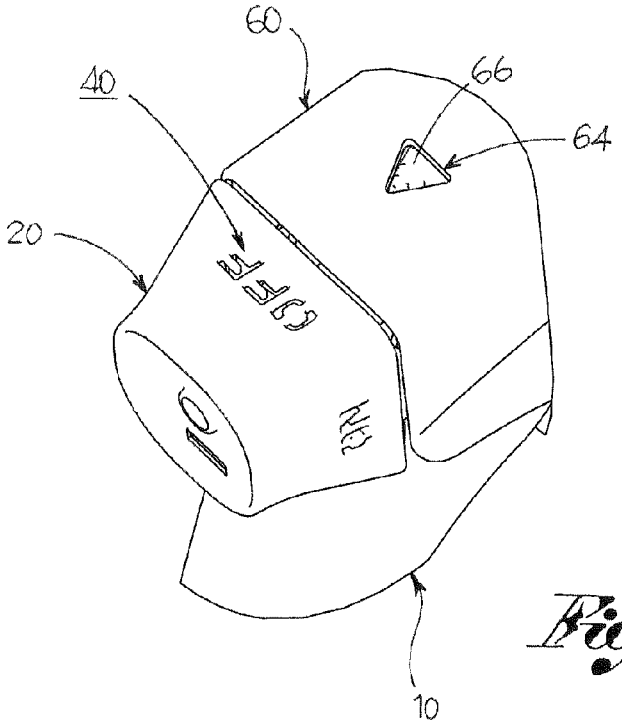
Figure 2B:
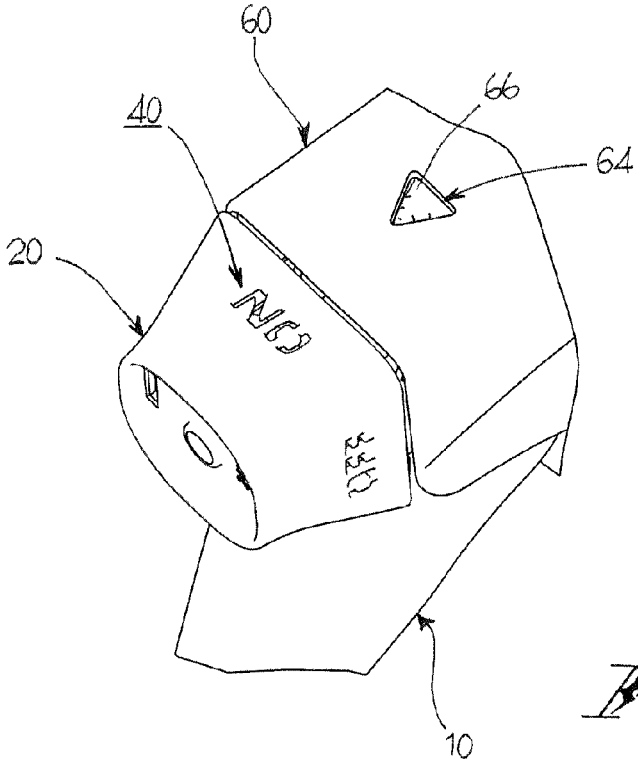
Figure 3:
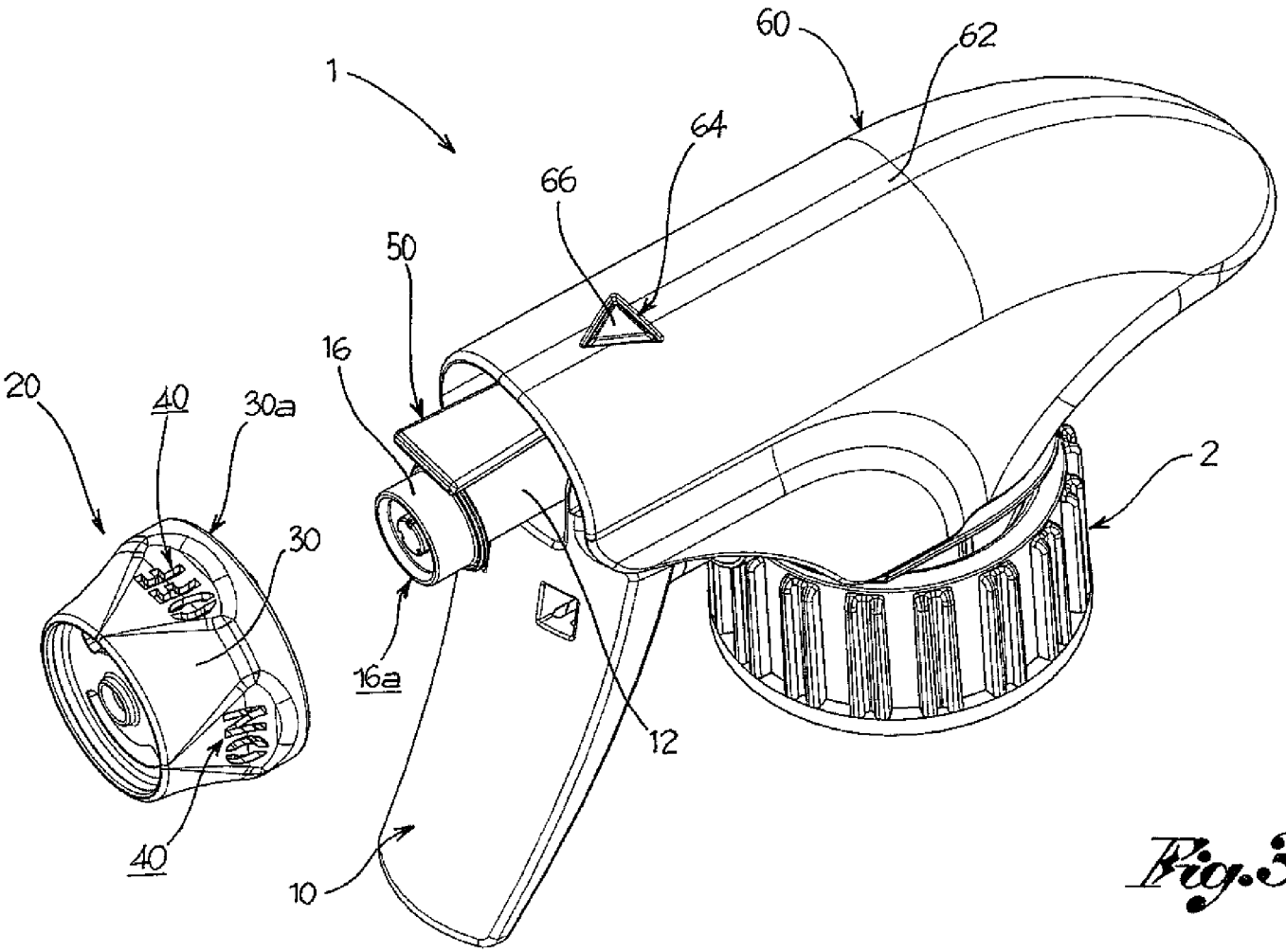
FIG. 3 shows a dispenser device head according to the present invention, in separate parts.

In a further embodiment variation, the nozzle 20 can be rotated so as to assume an open configuration or closed configuration (FIGS. 1, 2*a* and 2*b*).

In such variation, the nozzle comprises at least two apertures 40, angularly distanced on the lateral wall 30 of the nozzle. For example the two apertures define the captions "ON" and "OFF" or respective symbols indicating aperture and closure.

In a first angular position of the nozzle 20, the dispenser duct 4 is in communication with the orifice 22 and the indicator aperture 64 is aligned with the "ON" aperture on the nozzle (FIG. 2*b*). In a further angular position of the nozzle 20, rotated in relation to the former, the dispenser duct 4 is fluidically separate from the orifice 22 and the indicator aperture 64 is aligned with the "OFF" aperture on the nozzle (FIG. 2*a*).

Figure 4:
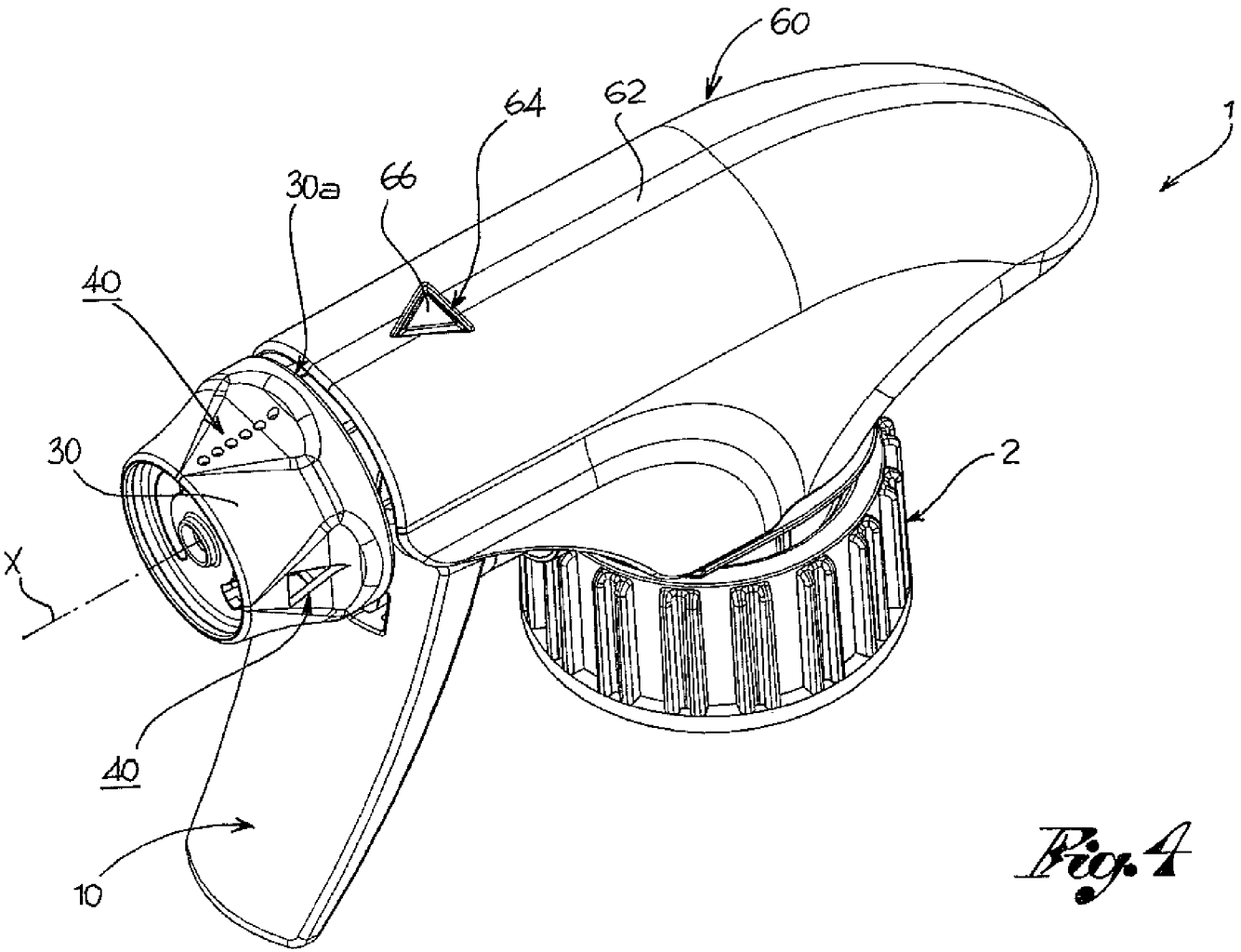
FIGS. 4, 5 and 6 show a dispenser device head according to the present invention, according to a further embodiment, in subsequent functioning configurations.
Figure 5:
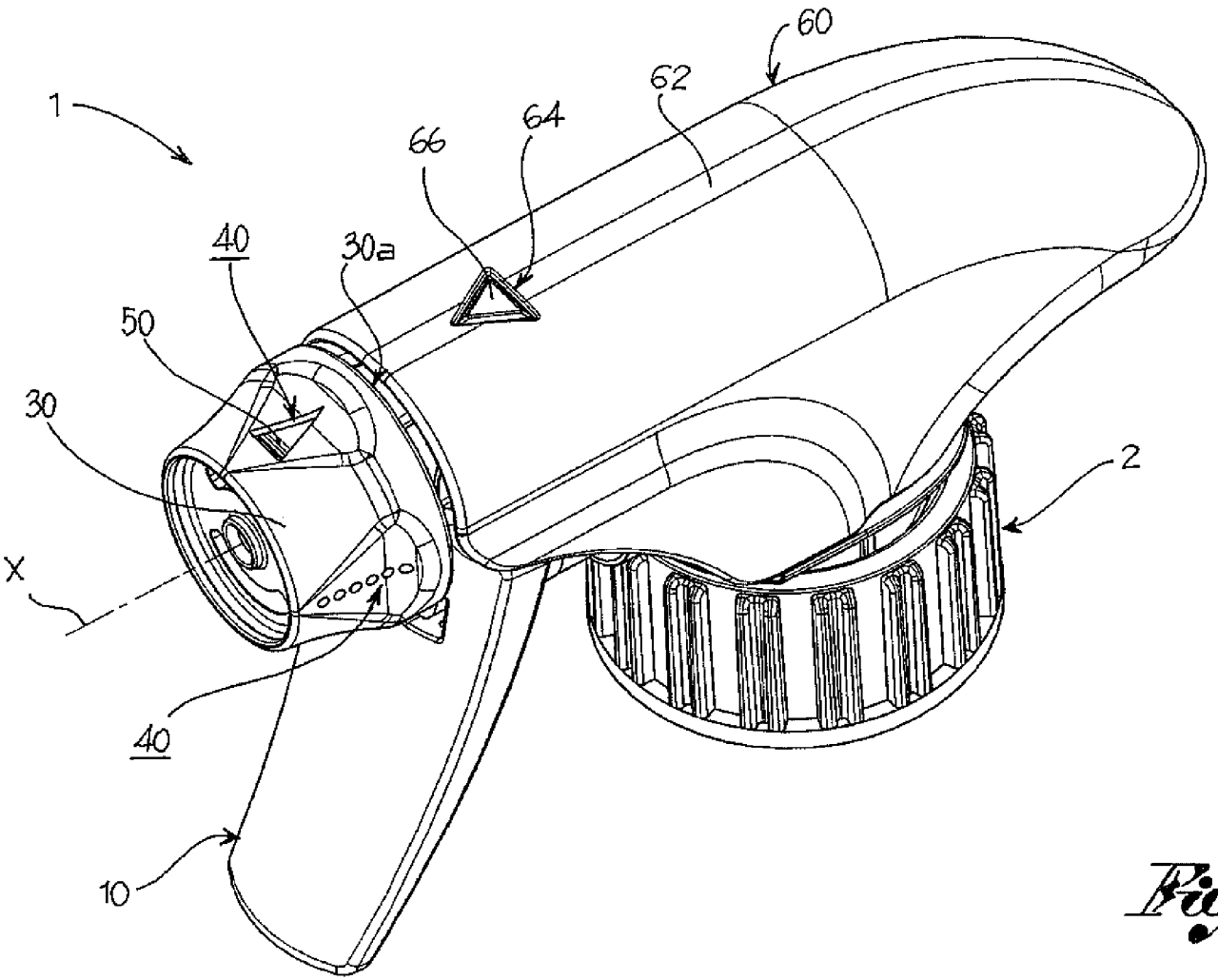
Figure 6:
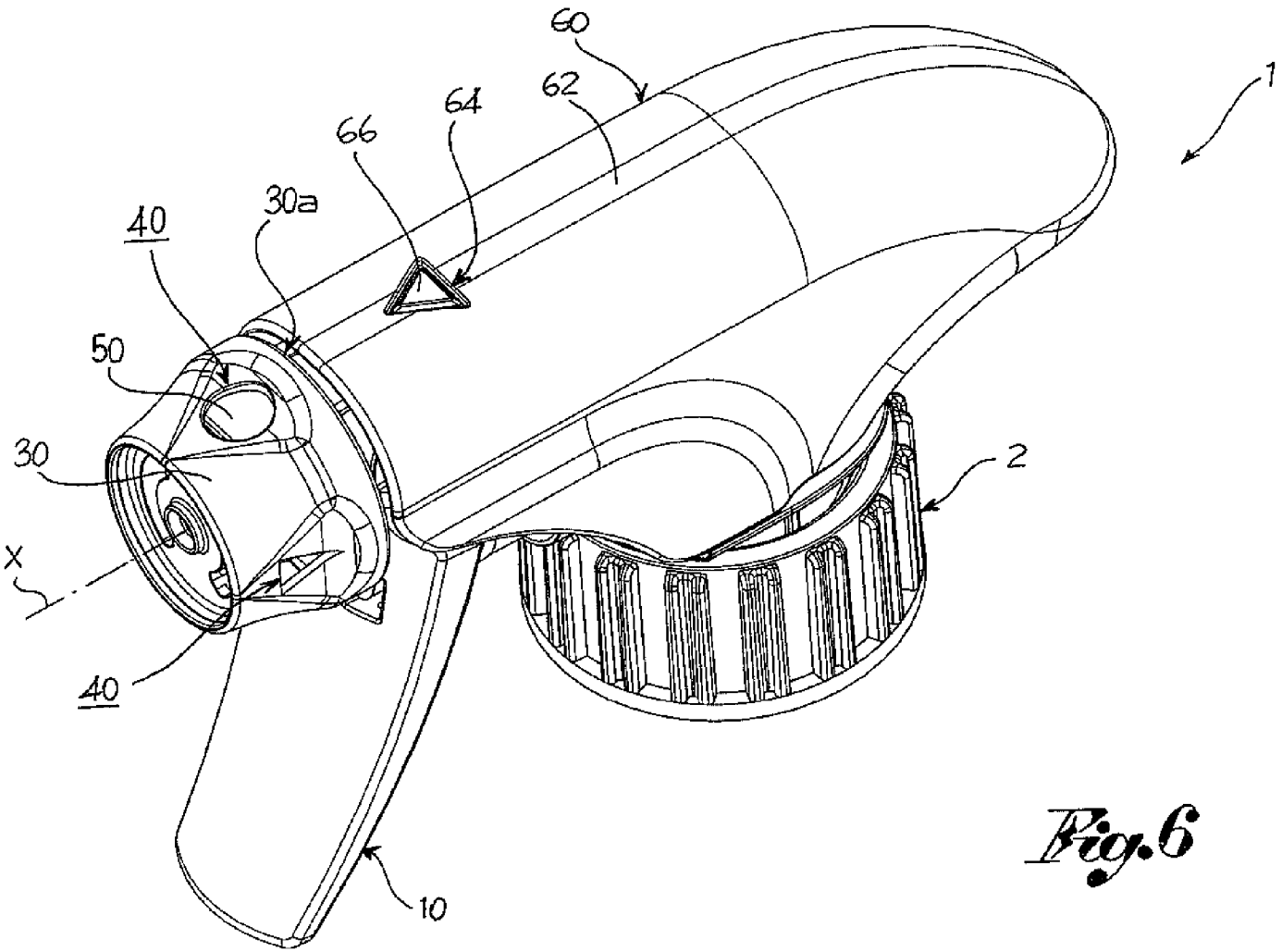

In yet a further embodiment variation, the nozzle 20 comprises at least two orifices and selector devices able to place the dispenser duct in fluidic communication alternately with one or other of the orifices by rotation of the nozzle (FIGS. 4, 5 and 6).

In such embodiment variation, the nozzle comprises four different apertures 40, angularly distanced on the lateral wall 30 of the nozzle. An aperture relative to a first functioning configuration (such as, a mainly directed jet, FIG. 4), an aperture relative to a second functioning configuration (such as a nebulised jet, FIG. 6), two apertures, alternated with the first, relative to a closed functioning configuration (FIG. 5).

In a first angular position of the nozzle 20, the dispenser duct 4 is in communication with the orifice 22, the selector devices select the path of the liquid for the directed jet, the indicator aperture 64 is aligned with the aperture 40 relative to the symbol of the mainly directed jet; in a further angular position of the nozzle 20, rotated in relation to the former, the dispenser duct 4 is fluidically separate from the orifice 22 and the signalling aperture 64 is aligned with the aperture 40 relative to the closed symbol (FIG. 5); in a further angular position of the nozzle 20, the dispenser duct 4 is in communication with the orifice 22, the selector devices select the path of the liquid for the nebulised jet, the indicator aperture 64 is aligned with the aperture 40 relative to the symbol of the nebulised jet (FIG. 6); in a subsequent angular position of the nozzle 20, rotated in relation to the former, the dispenser duct 4 is again fluidically separate from the orifice 22 and the indicator aperture 64 is aligned with the aperture 40 again relative to the closed symbol (FIG. 5).

Innovatively, the dispenser device head according to the present invention makes it possible to considerably highlight the captions or symbols present on the nozzle, at the same time limiting the production costs of the component.

It is clear that a person skilled in the art may make modifications to the dispenser device head described above, so as to satisfy contingent requirements, while remaining within the sphere of protection as defined by the following claims.

The invention claimed is:

1. A dispenser device head for a liquid associable with a container, comprising:

a dispenser duct delimited by an integrated one-piece tubular wall extending along a dispensing axis between an input extremity that receives fluid directly from a pump device and an outlet extremity provided with an outlet aperture;

a nozzle joined to the outlet extremity of the duct, provided with at least one orifice suitable for being placed in fluidic communication with the duct, wherein the nozzle comprises a lateral wall extending along the dispensing axis of the duct, axially overlaying said duct, wherein between the lateral wall and the duct a nozzle compartment is formed; and a signaling element housed at least partially in the nozzle compartment;

wherein the nozzle has at least one signaling aperture passing through the lateral wall to highlight a functioning configuration and shaped to define a letter or a symbol, the signaling element being visible from outside through the signaling aperture, and wherein the signaling element is part of a frame from which said tubular wall is a part of.

2. The head according to claim 1, wherein the nozzle can rotate around the dispensing axis.

3. The head according to claim 2, wherein the nozzle has a number of angularly separated signalling apertures on the lateral wall, to indicate different functioning configurations.

4. The head according to claim 2, wherein the nozzle is rotatable about the dispensing axis relative to the signalling element.

5. The head according to claim 1, wherein the lateral wall is defined axially by a peripheral wall rim and the signalling aperture is defined by an aperture rim axially distanced from the wall rim.

6. The head according to claim 1, wherein the signalling element is made in a contrasting colour to the outer surface of the lateral wall of the nozzle.

7. The head according to claim 6, wherein the signalling element has such a disposition or extension of the visible surface of the signalling aperture as to conceal from view further components positioned between said signalling element and the duct.

8. The head according to claim 1, comprising a cover from which the nozzle protrudes, comprising an upper wall, distanced from the dispensing axis forming a cover compartment, wherein the upper wall has an indication aperture, passing through the thickness.

9. The head according to claim 8, comprising a further signalling element, positioned at least partially in the cover compartment, visible from the outside through the indication aperture.

10. The head according to claim 9, wherein the further signalling element is inserted in the indication aperture, so as to come out on the outer surface of the upper wall.

11. The head according to claim 9, wherein the further signalling element is made in a contrasting colour to the outer surface of the upper wall.

12. The head according to claim 9, wherein the further signalling element is positioned and extends so as to cover up the other components present in the cover compartment, so that these are not visible from the outside through the indication aperture.

13. The head according to claim 9, wherein the further signalling element is supported by the tubular wall which defines the dispenser duct or by a frame which the tubular wall is a part of.

14. The head according to claim 9, wherein the signalling element and the further signalling element are made in one piece.

15. The head according to claim 1, comprising:

a pumping device to aspirate the liquid from the container and convey it to the dispenser duct, for example comprising a piston and a chamber which the piston slides in; and manual operating devices for actuating the pump device, comprising a rotating or moveable trigger.

16. A dispenser device comprising:

a container; and a dispenser device head (1) made according to claim 1.

17. A dispenser device head for a liquid container, comprising:

a dispenser duct extending along a dispensing axis, terminating in an outlet extremity provided with an outlet aperture;

a nozzle joined to the outlet extremity of the duct, provided with at least one orifice suitable for being placed in fluidic communication with the duct, wherein the nozzle comprises a lateral wall extending along the dispensing axis of the duct, axially overlaying said duct, wherein between the lateral wall and the duct a nozzle compartment is formed; and a first signaling element housed at least partially in the nozzle compartment;

wherein the nozzle has at least one signaling aperture passing through the lateral wall to highlight a functioning configuration and shaped to define a letter or a symbol, the first signaling element being visible from outside through the signaling aperture, and wherein the nozzle is rotatable about the dispensing axis relative to the signaling element.

18. The head according to claim 17, further comprising a cover from which the nozzle protrudes, the cover including an upper wall that is radially spaced apart from the dispensing axis and forms a cover compartment, wherein the upper wall defines an indication aperture that passes through the upper wall and is axially spaced apart from the at least one signalling aperture.

19. The head according to claim 18, further comprising a second signalling element, positioned at least partially in the cover compartment and axially spaced apart from the first signaling element, wherein the second signalling element is visible from the outside through the indication aperture.

20. The head according to claim 19, further comprising a tubular wall that delimits the dispensing duct, wherein the tubular wall, the first signaling element, and the second signaling element are integrally formed.

* * * * *